United States Patent [19]

Anderson

[11] Patent Number: 4,717,282

[45] Date of Patent: Jan. 5, 1988

[54] ROLLER CARRIAGE ASSEMBLY FOR USE WITH A ROAD SURFACE FINISHING MACHINE

[76] Inventor: Roger K. Anderson, P.O. Box 293, New Middletown, Ind. 47160

[21] Appl. No.: 885,768

[22] Filed: Jul. 15, 1986

[51] Int. Cl.[4] ..... E01C 19/28; E01C 19/29

[52] U.S. Cl. ..... 404/122; 404/103; 404/117; 74/87

[58] Field of Search ..... 404/128, 122, 103, 110, 404/115, 117; 180/20; 254/126; 248/421; 74/61, 87; 366/128

[56] References Cited

U.S. PATENT DOCUMENTS

| | | | |
|---|---|---|---|
| 2,508,934 | 5/1950 | Berg | 254/126 X |
| 2,745,326 | 5/1956 | Green | 404/117 |
| 3,333,553 | 8/1967 | Krokos | 254/126 X |
| 3,415,174 | 12/1968 | Kaltenegger | 404/117 |
| 3,450,011 | 6/1969 | Goobersen | 404/122 |
| 3,482,494 | 12/1969 | Jennings, Jr. | 404/110 |
| 3,665,823 | 5/1972 | Chaney et al. | 404/128 |
| 3,737,244 | 6/1973 | Wilson | 404/117 |
| 3,814,532 | 6/1974 | Barrett et al. | 404/117 |
| 3,989,404 | 11/1976 | Burton | 404/128 |
| 4,260,280 | 4/1981 | Hirn et al. | 404/117 X |

*Primary Examiner*—James A. Leppink
*Assistant Examiner*—Matthew Smith
*Attorney, Agent, or Firm*—Maurice L. Miller, Jr.

[57] ABSTRACT

A roller carriage assembly for a road surface finishing machine of the type having an elongated main frame is disclosed. The assembly features a vibrating drum or roller wherein rotating eccentric weights used to generate vibrations can be rotated at speeds which are independent of the speed of roller rotation to thus permit the finishing of extremely low slump concrete. The assembly employs a scissors extender system which permits rapid and precise changes in the level of the roller relative to the main frame without affecting the attitude of the former relative to the latter. The scissors extender system is locked in place by a rotating locking mechanism and is rigidified by the use of four chains disposed at the corners of the system and strung between upper and lower plates between which the scissors mechanism operates.

16 Claims, 11 Drawing Figures

ROLLER CARRIAGE ASSEMBLY FOR USE WITH A ROAD SURFACE FINISHING MACHINE

BACKGROUND OF THE INVENTION

This invention relates generally to road and other surface finishing machines. More specifically, the invention relates to a roller carriage assembly which is movably connected in the usual manner to the conventional double frame of such a machine for movement back and forth across such a surface to consolidate and finish the same with a vibrating drum or roller, including means for changing the level of the roller relative to the double frame as will be necessary when adapting the machine to different job sites.

Generally speaking, road surface finishing machines, having an elongated double main frame adapted to span above and across a roadway or other surface being finished from which is suspended a roller frame containing a vibrating drum or roller adapted to move back and forth along the main frame and roll across the surface or placed to condolidate and finish concrete or other materials freshly poured or placed thereabout, have long been known and used in the prior art. The double frames of such machines contain legs or standards on each end thereof, on the lower ends of which roller assemblies are connected. The roller assemblies ride upon tubular rails laid along both sides of the surface being finished. Accordingly, the double main frame of the machine can thus be rolled along the guide rails to advance the same along the surface as concrete or other material is being poured or placed in front thereof, while the roller frame moves along the double frame back and forth across the same along the leading edge of the freshly placed material to permit a vibrating roller to consolidate and finish the same. Examples of such prior art machines are the Series 36 concrete finishers manufactured by Bidwell Division of CMI Corporation, Canton, S. Dak. 57013, and the C-450-X finisher as manufactured by Gomaco Corporation, Ida Grove, Ia. 51445.

One of the problems encountered using these prior art machines with conventional roller carriage assemblies is that it is extremely difficult to change the level of the roller relative to the main frame which usually must be done when adapting such machines to different job sites. Another problem encountered using the conventional assemblies is the relatively narrow range of vibrating frequencies that can be obtained in the rollers due to the fact that the rotating eccentric weights used to generate the vibrations are dependent upon the speed of the roller itself.

By means of my invention, these and other difficulties encountered using conventional road surface finishing machines and roller carriage assemblies are substantially overcome.

SUMMARY OF THE INVENTION

It is an object of my invention to provide a novel roller carriage assembly for use with a double main frame of an otherwise conventional surface finishing machine.

It is a further object of my invention to provide a highly efficient vibrating roller assembly for a concrete finishing machine which will permit the consolidation and finishing of extremely low slump concrete.

It is yet another object of my invention to provide a roller carriage assembly for suspension from a double main frame of an otherwise conventional surface finishing machine wherein the level of the roller carried by the assembly relative to the main frame is readily adjustable.

It is also an object of my invention to provide a novel scissors extender system for adjusting the level of a finishing roller relative to the main frame from which it is suspended.

Briefly, in accordance with my invention, there is provided a roller carriage assembly for a finishing machine for a road or other surface of the type which includes a main frame adapted to extend above and across the surface being finished. The roller carriage assembly includes an upper frame mounted in the main frame for movement back and forth across the surface being finished. The assembly also includes a roller means for rolling upon and across the surface being finished. Lastly, the assembly includes means connecting the roller means to the upper frame for selectively changing the vertical distance between the upper frame and the roller means while maintaining a fixed attitude of the roller means relative to the upper frame.

These and other object, features and advantages of the present invention will become apparent to those skilled in the art from the following detailed description and attached drawings upon which, by way of example, only a single preferred embodiment of my invention is shown and described.

DESCRIPTION OF THE PREFERRED EMBODIMENT

Figure 1:
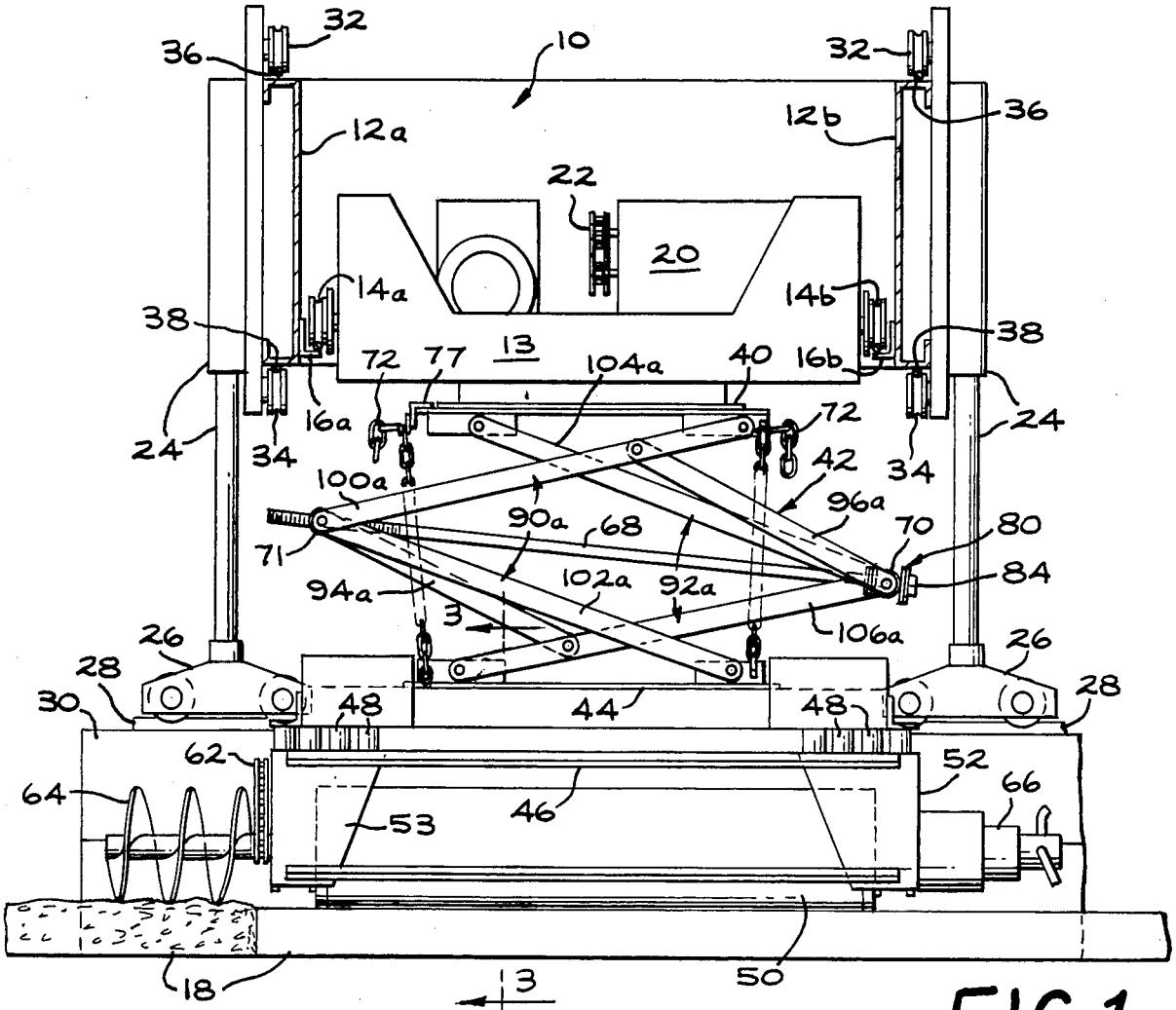
FIG. 1 shows a side elevation view of a road surface finishing machine containing a height adjustable, vibratory roller mounted in a horizontally movable roller carriage assembly, thus illustrating one preferred embodiment of my invention.
Figure 3:
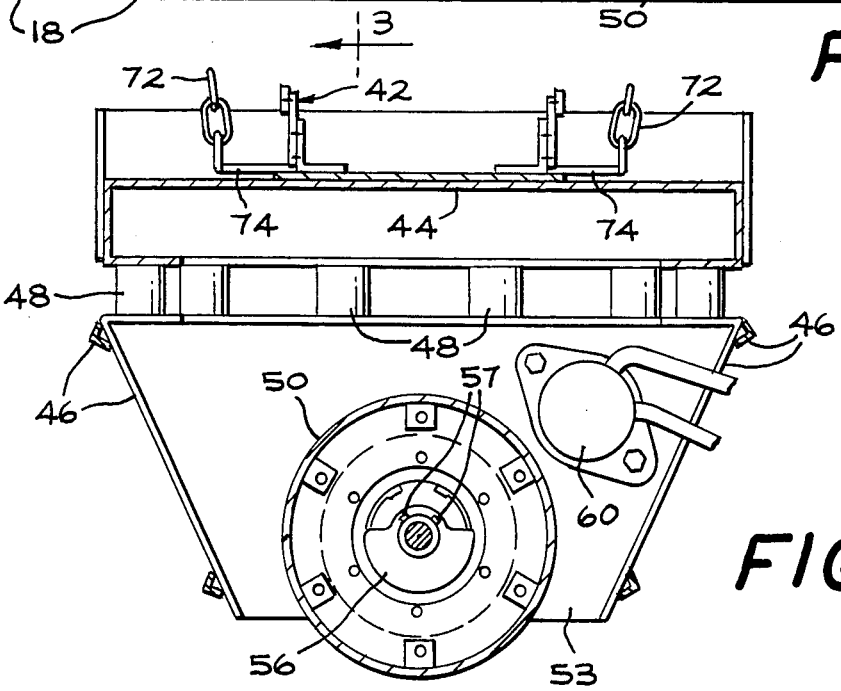
FIG. 3 shows a cross-sectional and elevation view of a portion of the roller and carriage assembly of FIG. 1 as viewed along cross-section lines 3—3 of the latter mentioned figure.

Referring now to the drawing figures, there is shown, in one preferred embodiment of my invention, a roller carriage 10 movably mounted on a conventional double frame 12*a,b* of a road surface finishing machine. The assembly 10 is suspended from the frame 12*a,b* by means of rollers 14*a,b* connected to an upper frame 13 which travel along tracks formed by two angle brackets 16*a,b* such that the assembly 10 can be moved from one side to the other and back across a road surface 18 to finish the same. A motor 20 and gear and chain assembly 22 drive the carriage 10 along the brackets 16*a,b* in the usual, well known manner. The frame 12*a,b* is elevated above the roadway 18 by means of two pairs of standards 24 located on opposite end portions thereof, only one of which pairs is shown. The standards 24 contain roller assemblies 26 which engage and roll along steel tubes 28 which extend along the top of a series of concrete barriers 30 positioned end-to-end along both sides of the roadway being paved and finished. The upper end portions of the standards 24 likewise contain rollers 32 and 34 which are rollably mounted on steel tubes 36 and 38, respectively. The tubes 36 and 38 are welded to upper and lower surfaces of the frames 12*a,b*. Thus the standards 24 can be adjusted to roll upon tubes extending along spaced, parallel sets of barriers having different distances between the sets to permit finishing roadways of different widths.

The carriage 10 includes the upper frame 13, a flat rectangularly shaped upper plate 40 fixedly connected to the underside of the upper frame 13, and a scissors extension mechanism 42 pivotally connected to and between the upper plate 40 and a lower plate 44. Also included is a roller housing 46 attached to the lower plate by means of suitable threaded fasteners which extend through a series of cylindrically shaped shock absorbers 48. the shock absorbers 48 may be made of rubber, plastic or other suitable compressible, resilient material. A hollow, elongated, cylindrically shaped roller 50 is rotatably mounted to end walls 52 and 53 of the roller housing 46. An elongated steel shaft 54 extends along the longitudinal axis of the roller 50 and connects to the end walls of the roller 50 for free floating rotation independent of the rotation of the latter.

Figure 2:
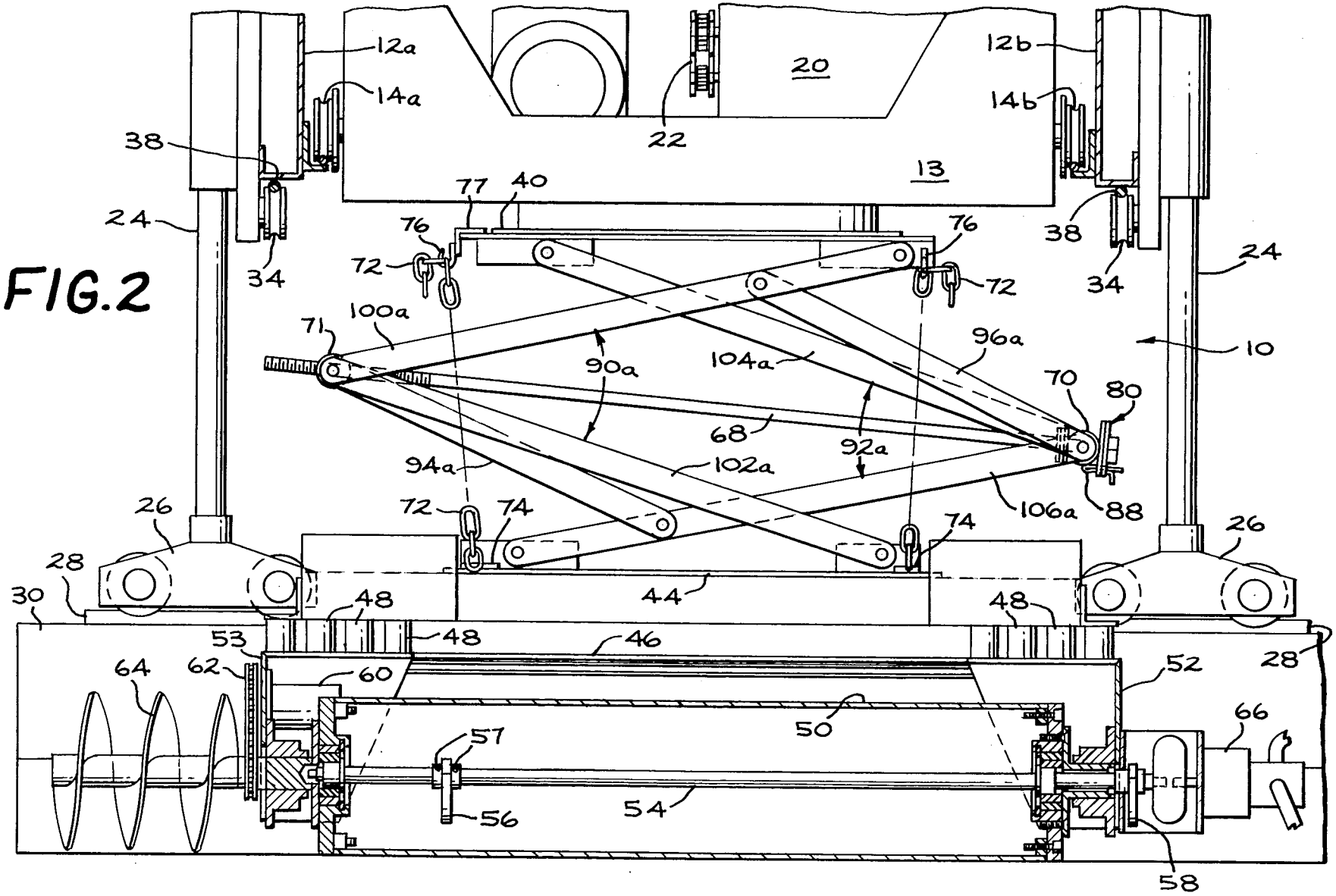
FIG. 2 shows an enlarged side elevation view of a portion of the machine, roller and carriage assembly of FIG. 1, the same as viewed in the latter figure except with certain surface parts torn away for viewing internal features.
Figure 4:
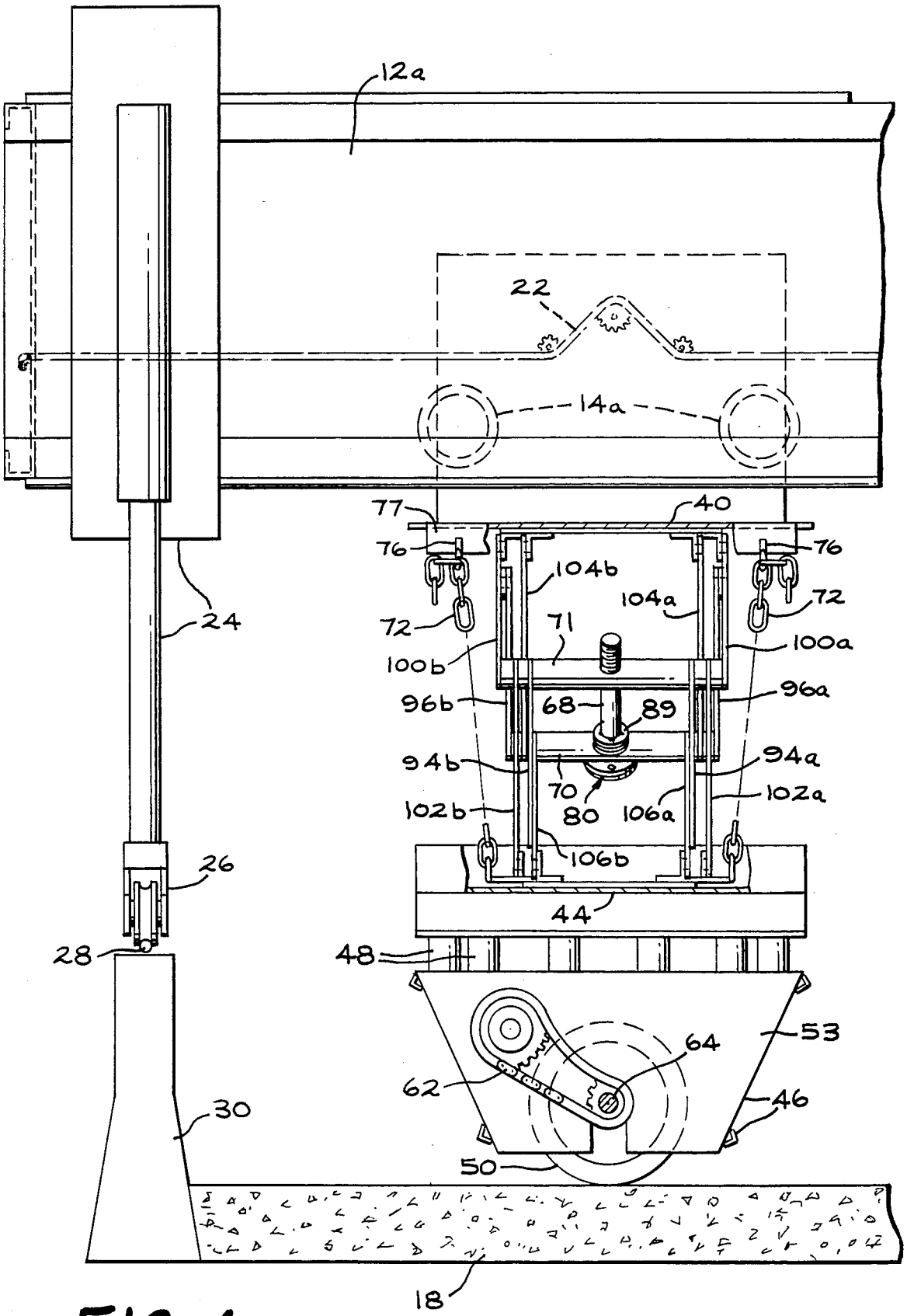
FIG. 4 shows a left end elevation view of the roller and carriage assembly of FIG. 1 looking in a direction opposite that of FIG. 3 with the auger mechanism of FIG. 1 torn away.
Figure 9:
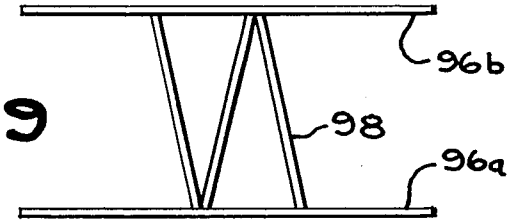
FIGS. 6–11 show top plan views of the various arms of the scissors extension system used in the carriage assembly of FIG. 1 with reinforcing members adjoining the different arm pairs.
Figure 10:
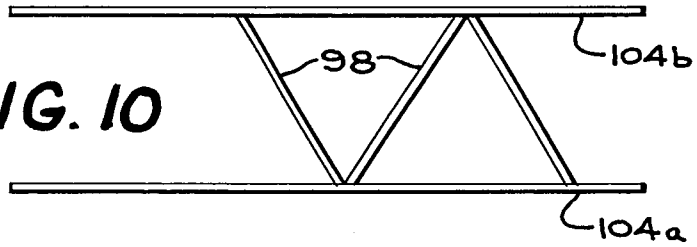
Figure 11:
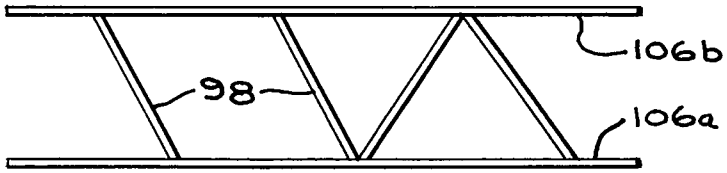

A first vibratory member or eccentric mass 56 is fixedly connected to the shaft 54 for rotation with the latter. A pair of screws 57 located in the collar of the mass 56 can be loosened to permit placement of the mass 56 at any desired position along the shaft 54. At least one of the end walls of the roller 50 should be removable to permit access to the mass 56 for adjustment of the latter. In the present example of the invention, both end walls of the roller 50 are shown as being removable by means of bolts (See FIG. 2). A companion or second eccentric mass 58 (FIG. 2 only) is likewise fixedly mounted in line with the longitudinal axis of the shaft 54 on the outside surface of the sidewall 52 and outside of the roller 50. A hydraulic motor 60 located on an inside surface of the sidewall 53 drives a sprocket and chain 62 which, in turn, rotatably drives the roller 50 and an auger 64 located at the front of the roller 50. Similarly, a hydraulic motor 66 coupled to the shaft 54 rotates the latter and the eccentric masses 56 and 58 independently of the rotation of the roller 50 at any desired speed within a range of speeds depending upon the characteristics of the motor for selecting any desired frequency of vibration desired within a range of frequencies. I have found that by placing the mass 56 closer to the wall 53 than to the wall 52, most of the large amplitude vibrations will occur along a front end portion of the roller 50 where the concrete to be finished is deepest and tend to dampen out toward the rear end of the roller 50, all of which is highly desirable.

The extension mechanism 42 is expanded and contracted vertically by adjusting an elongated threaded bolt 68 to respectively lower and raise the roller 50 relative to the upper frame 13 from which it is suspended. The bolt 68 extends across the mechanism 42 through cross members 70 and 71. Once the desired level of the roller 50 is precisely set with the bolt 68, a series of four chains 72 which are welded on their lower ends to bars 74 affixed to the four corners of the plate 44 are drawn tight by hand and attached along their upper ends to hooks 76 connected to angles 77 and 78 at the front and rear corners of the upper plate 40. Once the chains 72 are hooked, the bolt 68 can be further turned until the chains 72 are drawn tight to thus rigidify the roller carriage assembly 10.

Figure 5:
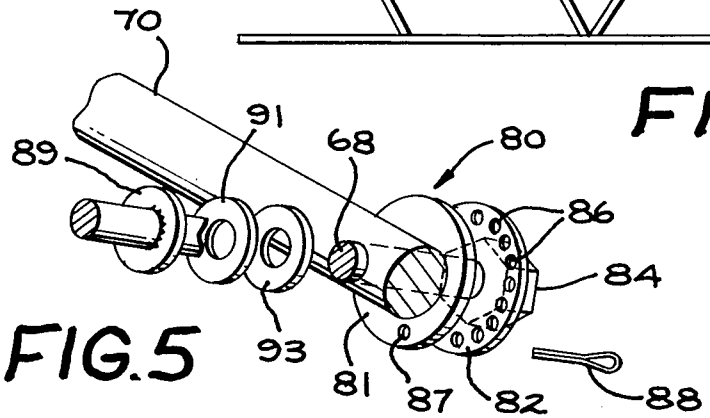
FIG. 5 shows an exploded perspective view of a portion of the carriage assembly of FIG. 1 illustrating the construction of a locking mechanism for a scissors extension system used in the carriage assembly.
Figure 6:
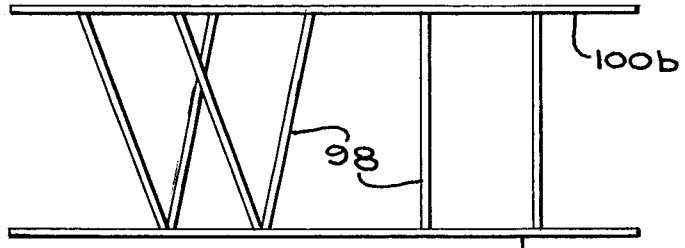
Figure 7:
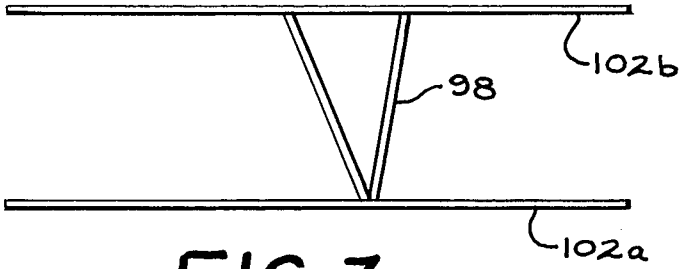
Figure 8:
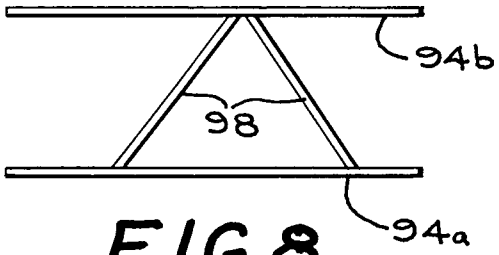

The mechanism 42 can be locked to maintain the roller 50 at the desired level below the upper frame 13 by means of a locking device 80 which is best shown in FIG. 5. The locking device 80 includes two flat disc-shaped plates 81 and 82 disposed over the bolt 68, the plate 81 being welded in a stationary position to the cross member 70 and the plate 82 being welded to the head 84 of the bolt 68 for rotation as the bolt is rotated. The plate 82 contains a series of openings 86 disposed in a circle around a peripheral portion thereof. The plate 81 contains a single opening 87 in a peripheral portion thereof which will register successively with each of the openings 86 as the bolt 68 and plate 82 are rotated through a complete circle. When the bolt 68 has been turned to place the mechanism 42 at the proper extension so as to place the roller 50 at the desired level, a cotter key 88 is inserted through any one of the openings 86 which is nearest in registry with the opening 87 and thence through the latter opening to lock the two plates 81 and 82 together in a fixed position of rotational alignment. In this manner, the roller 50 is locked at the desired level below the upper frame 13. A nut and bolt or other suitable fastener may be used in place of the cotter key 88 to lock the plates 81 and 82 together if preferred. A metal washer 89 is welded to the bolt 68 to confine a free rotating plastic washer 91 and a free rotating flat metal washer 93 against the cross member 70.

The mechanism 42 differs from other conventional forms of scissors extenders and jacks in that it includes a first and second pair of scissors 91*a,b* and a third and fourth pair of scissors 92*a,b*, wherein the first and second pair open toward the third and fourth pair and vice versa. All of the distal ends of which arms of the scissors 90*a,b* and 92*a,b* are pivotally connected to angles affixed to the corners of the plates 40 and 44 so that none of the scissors arms slide or translate along the plates as the mechanism 42 is extended or retracted. The mechanism 42 also includes a pair of relatively short alignment arms 94*a,b* pivotally connected to opposite end portions of the cross member 71 and to the pair of lower arms of the scissors 92*a,b* and another pair of short alignment arms 96*a,b* pivotally connected to opposite end portions of the cross member 70 and to the pair of upper arms of the scissors 90*a,b*.

Finding the precise point of attachment of the alignment arms 94*a,b* with the lower arms of the scissors 92*a,b* and of the alignment arms 96*a,b* with the upper arms of the scissors 90*a,b*, while critical for maintaining the plates 40 and 44 parallel with one another throughout the range of extension of the mechanism 42, will require some experimenting. One suitable example of the invention constructed by me employed upper and lower arms of the scissors 90*a,b* and 92*a,b* which were 39½ inches in length between the centerline of the pivots at each end thereof. The alignment arms 94*a,b* and 96*a,b* were 26½ inches in length between centerlines of the pivots at each end thereof. The arms 94*a,b* were pivotally connected to the lower arms of the scissors 92*a,b* a distance of 10 inches from the centerline of the lower end pivot of the latter. Similarly, the arms 96*a,b,* were pivotally connected to the upper arms of the scissors 91*a,b* a distance of 10 inches from the centerline of the upper end pivot of the latter. These dimensions allowed the plates 40 and 44 to maintain parallel alignment through a range of spacing of from 5 to 40 inches.

Referring now particularly to FIGS. 6–11, reinforcing rods 98 are shown interconnecting the pair of upper arms 100*a,b* of the scissors 90*a,b,* as interconnecting the lower arms 102*a,b* of the scissors 90*a,b,* as interconnecting the alignment arms 94*a,b,* as interconnecting the alignment arms 96*a,b,* as interconnecting the upper arms 104*a,b* of the scissors 92*a,b* and as interconnecting the lower arms 106*a,b* of the scissors 92*a,b,* respectively.

Although the present invention has been described with respect to specific details of a certain preferred embodiment thereof, it is not intended that such details limit the scope of this patent otherwise than as specifically set forth in the following claims.

I claim:

1. In a surface finishing machine for a road or other surface of the type which includes a main frame adapted to extend above and across a surface being finished, a roller carriage assembly comprising an upper frame connected to said main frame for movement back and forth above and across said surface, a lower frame disposed beneath said upper frame, roller means for rolling upon and across said surface for finishing the same, said roller means being connected to said lower frame, a scissors type extension mechanism disposed between and being pivotally connected to said upper and lower frames for suspending said roller means and for selectively changing the distance between said upper and lower frames such that the vertical distance between said roller means and upper frame can be changed by any desired amount between fully retracted and fully extended positions of said scissors, and means for locking said scissors for maintaining a selected distance between said upper and lower frames.

2. The assembly of claim 1 wherein said upper and lower frames comprise a pair of plates.

3. The assembly of claim 1 further comprising an elongated shaft extending along the longitudinal axis of said roller means and connected to opposite end walls of said roller means for free floating rotation independent of rotation of said roller means, a first eccentric mass fixedly connected to said shaft within said roller means for rotation with said shaft, a second eccentric mass fixedly mounted in line with the longitudinal axis of said shaft on an outside surface of and end wall of said roller means, and means for rotating said shaft and eccentric masses independently of the rotation of said roller means.

4. The assembly of claim 2 wherein said mechanism comprises first and second spaced, parallel cross members disposed in a plane extending between said upper and lower plates, first and second scissors having apexes pivotally connected to opposite end portions of one of said cross members and having distal ends pivotally connected to opposite edge portions of said upper and lower plates, third and fourth scissors having apexes pivotally connected to opposite end portions of the other of said cross members and having distal ends pivotally connected to said opposite edge portions of said upper and lower plate, said first and second scissors opening into said third and fourth scissors, said first and second scissors having upper and lower arms which cross upper and lower arms of said third and fourth scissors.

a first pair of alignment arms having first corresponding ends pivotally connected to opposite end portions of one of said cross members and having second corresponding ends pivotally connected to upper arms of one of said pairs of scissors opening toward said one of said cross members, a second pair of alignment arms having first corresponding ends pivotally connected to opposite end portions of the other of said cross members and having second corresponding ends pivotally connected to lower arms of the other of said pairs of scissors opening toward said other of said cross members, an adjustable bolt extending through both of said cross members, and means for confining a head end portion of said bolt through one of said cross members, the other end portion of said bolt threadably engaging and extending through the other of said cross members such that rotation of said bolt changes the distance between said cross members which, in turn, changes the distance between said upper and lower plates.

5. The assembly of claim 4 further comprising means for locking the distance between said first and second cross members to lock the distance between said upper and lower plates.

6. The assembly of claim 5 wherein said locking means comprises first means slidably mounted on the shaft of said bolt between one of said cross members and the head of said bolt and being affixed to said one of said cross members, second means fixedly mounted on the shaft of said bolt between said first means and said bolt head and being rotatable with said bolt, a plurality of openings rotationally spaced from one another and disposed in a circle about a peripheral edge portion of one of said first and second means, an opening formed in a peripheral edge portion of the other of said first and second means on a circle of radius equal to the radius of the circle on said one of said first and second means such that rotation of said bolt rotates said opening relative to said plurality of openings until said opening on said other of said first and second means registers with one of said plurality of openings on said one of said first and second means; and means removably insertable through the registered openings in said first and second means to lock the rotational position of said bolt.

7. The assembly of claim 6 wherein said first and second means are disc shaped and adapted to slidably engage each other on opposing broad surfaces.

8. The assembly of claim 1 further comprising a plurality of chains adjustably connectable between corner portions of said upper and lower plates for rigidifying said assembly once a specific distance between said plates has been selected.

9. The assembly of claim 1 further comprising shock absorber means connected between said roller means and said lower plate for inhibiting the transfer of vibrations from said roller means to said lower plate.

10. The assembly of claim 9 wherein said shock absorber means comprises a plurality of cylindrically shaped shock absorbers inserted as spacers between said roller means and said lower plate, said spacers having fasteners inserted therethrough to connect said roller means to said lower plate.

11. In a surface finishing machine for a road or other surface of the type which includes a main frame adapted to extend above and across a surface being finished, a roller carriage assembly comprising an upper frame connected to said main frame for movement back and forth above and across said surface, a cylindrically shaped roller for rolling upon and across said surface for finishing the same, said roller being rotatably connected to said upper frame and having a pair of circular end walls, an elongated shaft extending along the longitudinal axis of said roller and being connected to opposite ones of said end walls for free floating rotation independent of the rotation of said roller, a first eccentric mass adjustably connected to said shaft within said roller for rotation with said shaft, a second eccentric mass connected in line with the longitudinal axis of said shaft outside of said roller for rotation with said shaft, said first mass being slidably adjustable along said shaft and at least one of said masses being rotationally adjustable about the longitudinal axis of said shaft, at least one of said end walls being removably connected to one end of said roller for permitting access to said first mass for adjusting the same, and means for rotating said shaft and masses together, independently of the rotation of said roller.

12. A concrete finishing machine comprising an elongated main frame adapted to be positioned transversely of a concrete surface to be finished, means for moving said main frame in a direction substantially at right angles to its long dimension for moving along and over a roadway surface to be finished, a carriage assembly movably mounted in said main frame for movement back and forth along the length of said main frame for crossing back and forth over a roadway surface to be finished, an upper frame connected to said assembly, a lower frame disposed beneath said upper frame, a vibrating roller suspended from said lower frame for finishing a low slump concrete surface, a scissors type extension mechanism pivotally connected between said upper and lower frames for suspending said roller means and for permitting the vertical distance between said carriage assembly and roller to be changed by any desired amount between fully retracted and fully extended positions of said mechanism.

13. The finishing machine of claim 12 further comprising shock absorber means connected between said carriage assembly and roller to inhibit the transfer of vibrations from said roller to said carriage assembly.

14. The machine of claim 12 further comprising means for generating and adjusting vibrations of said roller independent of rolling movement of said roller.

15. In a surface finishing machine for a road or other surface of the type which includes a main frame adapted to extend above and across a surface being finished, a roller carriage assembly comprising an upper frame mounted in said main frame for movement back and forth across said surface, roller means connected to said upper frame for rolling upon and across said surface for finishing the same, an elongated shaft extending along the longitudinal axis of said roller means and connected to opposite end walls of said roller means for free floating rotation independent of rotation of said roller means, a first eccentric mass connected to said shaft within said roller means for rotation with said shaft, a second eccentric mass mounted in line with the longitudinal axis of said shaft outside of said roller means, and means for rotating said shaft and eccentric masses independently of the rotation of said roller means.

16. A concrete finishing machine comprising an elongated main frame adapted to be positioned transversely of a concrete surface to be finished, means for moving said main frame in a direction substantially at right angles to its long dimension for moving along and over a roadway surface to be finished, a carriage assembly movably mounted in said main frame for movement back and forth along the length of said main frame for crossing back and forth over a roadway surface to be finished, a vibrating roller suspended from said carriage assembly for finishing a low slump concrete surface, means for generating and adjusting vibrations of said roller independent of rolling movement of said roller including an elongated shaft extending along the longitudinal axis of said roller and being connected to opposite end walls of said roller for rotation independent of the rotation of said roller, a first eccentric mass adjustably connected to said shaft within said roller for rotation with said shaft, and a second eccentric mass connected in line with the longitudinal axis of said shaft outside of said roller for rotation with said shaft, at least one of said masses being slidably adjustable toward and away from the other and at least one of said masses being rotationally adjustable about the longitudinal axis of said shaft.

* * * * *